United States Patent [19]

Fleming

[11] Patent Number: 4,813,438

[45] Date of Patent: Mar. 21, 1989

[54] NON-TOBACCO SMOKING COMPOSITION AND PROCESS FOR MAKING SAME

[76] Inventor: Morris Fleming, 536 South Marina, Prescott, Ariz. 86303

[21] Appl. No.: 87,217

[22] Filed: Aug. 20, 1987

[51] Int. Cl.[4] ..... A24B 15/18; A24D 1/18

[52] U.S. Cl. ..... 131/359; 131/369

[58] Field of Search ..... 131/359, 369

[56] References Cited

U.S. PATENT DOCUMENTS 12,417 2/1855 Goshon et al. ..... 131/359

3,934,594 1/1976 Beringer et al. ..... 131/359

*Primary Examiner*—Vincent Millin

*Attorney, Agent, or Firm*—Gregory J. Nelson

[57] ABSTRACT

A tobacco substitute product and method of making same. Bran, soybean and mesquite are initially treated in a solution including sodium chloride, sweetener, glycerol and a burning aid. The soybean is toasted and formed into flakes and mixed with the bran and mesquite. This composition is treated with a flavoring and a filler may also be added.

11 Claims, 1 Drawing Sheet

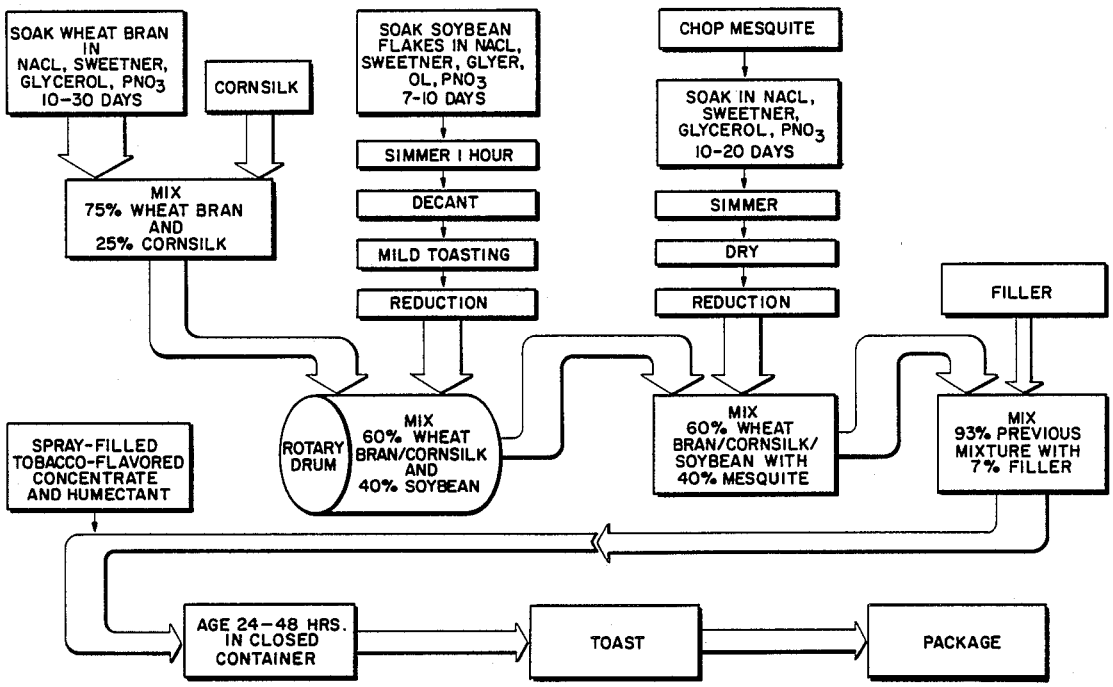

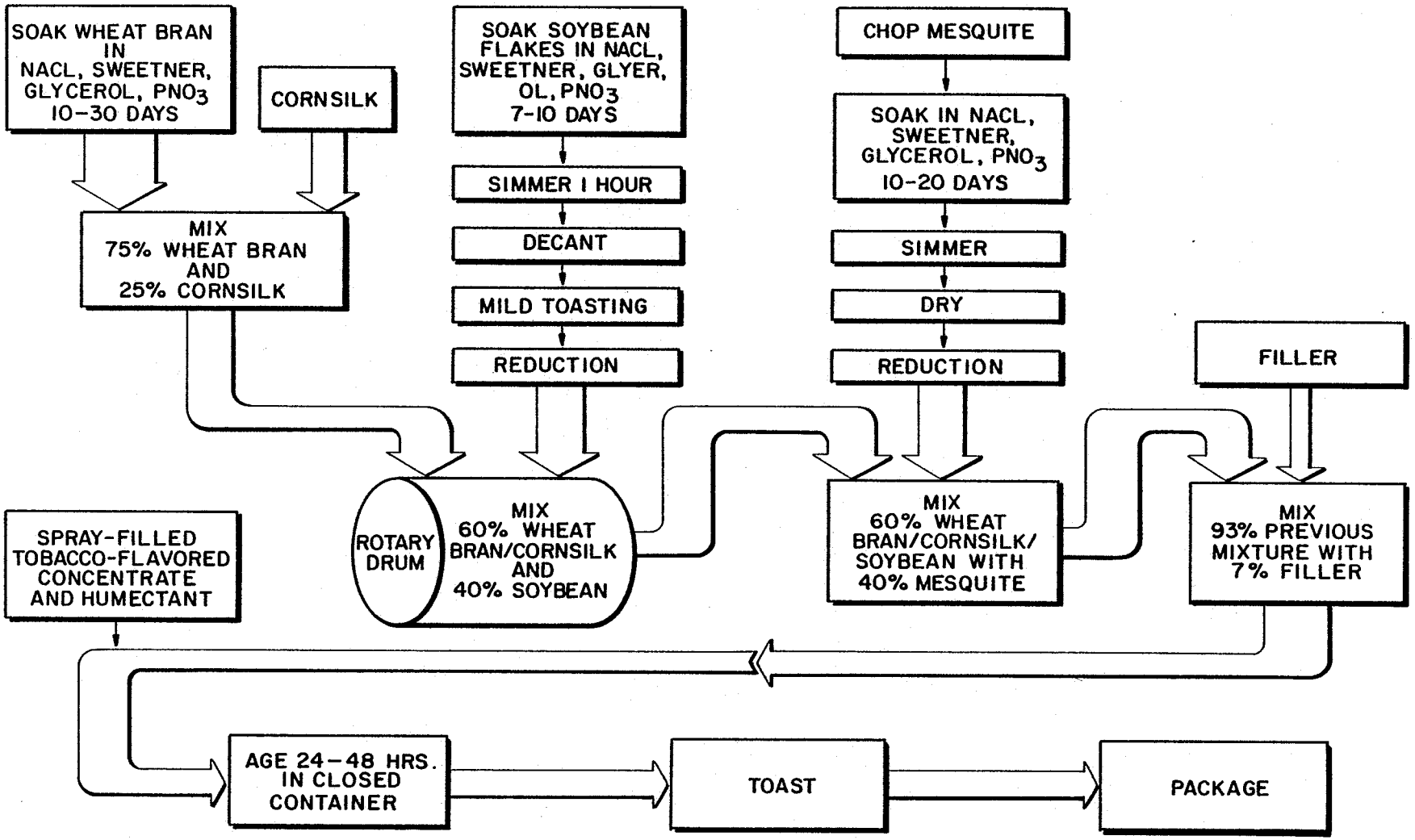
CHOP MESQUITE
SOAK IN NACL, SWEETNER, GLYCEROL, PNO3 10-20 DAYS
SIMMER
DRY
REDUCTION
MIX 60% WHEAT BRAN/CORNSILK/ SOYBEAN WITH 40% MESQUITE
FILLER
MIX 93% PREVIOUS MIXTURE WITH 7% FILLER
PACKAGE
SOAK SOYBEAN FLAKES IN NACL, SWEETNER, GLYER, OL, PNO3 7-10 DAYS
SIMMER 1 HOUR
DECANT
MILD TOASTING
REDUCTION
MIX 60% WHEAT BRAN/CORNSILK AND 40% SOYBEAN
ROTARY DRUM
TOAST
CORNSILK
SOAK WHEAT BRAN IN NACL, SWEETNER, GLYCEROL, PNO3 10-30 DAYS
MIX 75% WHEAT BRAN AND 25% CORNSILK
SPRAY-FILLED TOBACCO-FLAVORED CONCENTRATE AND HUMECTANT
AGE 24-48 HRS. IN CLOSED CONTAINER

NON-TOBACCO SMOKING COMPOSITION AND PROCESS FOR MAKING SAME

The present invention relates to an improved smoking composition and more particularly relates to an improved cigarette, cigar and pipe smoking composition which is composed essentially of a mixture of treated vegetable fibers which composition is essentially free of nicotine and is low in tar and which composition has smoking properties and characteristics similar to those of tobacco.

In recent years, there has been considerable medical investigation into the effects of smoking on the human body. It is almost universally accepted that smoking is extremely harmful to the smoker's health and may result or contribute to physiological conditions including lung problems, increased risk of cancer and heart disease. Nicotine and tars which are a result of burning tobacco and which occur in the smoke are considered to be the major harmful ingredients. When tobacco is burned, a substantial amount of the nicotine in the tobacco product is volatilized and is carried in the tobacco smoke. When the smoke is inhaled by the smoker, the volatized nicotine in the smoke is rapidly absorbed through the respiratory system and into the human circulatory system. A small amount of nicotine may also be deposited in the saliva of the smoker and on the tissues of the mouth and tongue which deposits can cause harm to the mouth of the smoker.

Because smoking is both physically and psychologically addictive, smokers have a very difficult time breaking the habit, even in the face of demonstrated medical and scientific evidence which supports the harmful effects of smoking. As an alternate smokers seek substitute smoking compositions and the prior art contains various smoking compositions and processes for the manufacture of tobacco substitutes which are either low or devoid of nicotine and tar. Generally, tobacco substitutes manufactured by these processes have not achieved much success as they do not simulate the taste and appearance of tobacco and, therefore, the those products do not have much commercial appeal. Further, many tobacco substitutes which are low in tar and nicotine are relatively expensive and may, in fact, introduce other substances which themselves are considered to be toxic or harmful.

Illustrative and representative of the prior art is U.S. Pat. No. 4,620,554 which shows a moderating agent for use in a cigarette which is a powder formed by compounding ascorbic acid, vegetable oil and fats, dried cumfrey leaves and at least one substance selected from wheat protein and soybean protein.

U.S. Pat. No. 3,934,594 suggests use of a tobacco substitute which includes a filler consisting of one or more of the following fiber components: wheat chaff, oat chaff, wheat straw, oat straw, wheat bran, oat bran, bran of other types, such as coffee bean shells and other types of nuts. Potassium nitrate, glycerin and glycol, molasses and other components are added to the filler.

The use of cornsilk fibers in the manufacture of cigarettes has been tried but has never achieved commercial importance primarily because the combustion of cornsilk results in the formation of an extremely irritating and acrid smoke, the pungency of which is so pronounced that attempts to mask the odor by blending cornsilk with other combustible fibers has not been successful. For example, U.S. Pat. No. 2,930,720 suggests the use of cornsilk and soy fibers as well as numerous other vegetables for preparing a non-nicotine bearing smoking composition.

Potassium nitrate and humicants, including glycerin are used to treat leafy materials such as lettuce, cabbage, broccoli, collard, spinach and papaya is described in U.S. Pat. No. 3,369,551.

From a review of the prior art as represented by the patents above, there are substantial patents which teach the use of various vegetable fibers as non-nicotine bearing substitutes for tobacco. However, as pointed out above, these processes and the products of such processes have not achieved much commercial success because of either the expense, or the resulting product which fails to closely simulate natural tobacco in taste and appearance.

Accordingly, there is a demonstrated need for a smoking composition which contains reduced nicotine concentrations and tar concentrations which composition would be relatively safe to the smoker. Further, any such composition must be commercially satisfactory providing a taste, color, flavor, texture and other smoking qualities closely simulating tobacco products.

The present invention provides such a process and product. Briefly, the composition of the present invention includes a mixture of vegetable material, as for example, unprocessed wheat bran, cornsilk, mesquite and soybean. In the processing of the composition, the wheat bran, soybean and mesquite are treated by initially soaking each in a solution consisting of equal parts of sodium chloride (10%), a sweetener, glycerol and a burning aid, such as potassium nitrate. The process steps involve toasting the soybean and forming flakes and mixing the treated soybean flake with bran and corn silk. Thereafter, mesquite is added to the mix and the mixture of bran, cornsilk, soybean and treated mesquite are subjected to a misting with a tobacco-flavored concentrate combined with a suitable humecant. An appropriate filler such as a carbonate of sodium, calcium or magnesium may be added prior to misting with a flavoring agent. The resulting product is ready to be incorporated into cigarettes or other tobacco products.

The above and other objects of the present invention will be more fully understood from the following description, examples and drawing which illustrates schematically the process steps involved in producing the product of the present invention.

According to a preferred embodiment of the present invention, a mixture of uncrushed vegetable fibers are treated and used as a tobacco substitute. The preferred vegetable fibers are the bran of wheat, oats, rye, barley and similar small grains, cornsilk, mesquite and soybean. Mesquite may be one of several shrubs or small trees found in the Southwestern United States characterized by a spiney appearance and deep roots such as the honey mesquite or the screw pod mesquite.

Initially, the unprocessed bran is treated in a treating solution in order to improve burning qualities and to render the vegetable material more pliable. The treating solution includes a saline solution such as sodium chloride, along with a suitable sweetener, an alcohol component and a burning agent. The bran is preferably soaked in this solution for a substantial period of time, as for example ten to thirty days. After the extended treatment in the solution, treated bran and corn silk are thoroughly mixed and blended in rotating drums Soybean is another vegetable ingredient which is also treated in the same solution described above for an extended period, typically seven to ten days. After soaking, the soybean material is subjected to an application of heat and allowed to simmer for a period of time and thereafter decanted and allowed to dry by subjecting the decanted soy flakes to toasting.

The toasted soybean material is then placed in a blender to reduce the consistency to a size suitable for mixing with the vegetable fibers, preferably the resulting material are flakes somewhat similar in size and appearance to corn flakes. The vegetable fibers, consisting of the bran and cornsilk, which have been previously soaked in the treatment solution are then mixed with the soybean flakes in an appropriate mixer such as a rotary drum.

Mesquite chips are prepared by first placing limbs and branches of the mesquite tree in a chopper to reduce the mesquite to the consistency of fine wood chips. Thereafter the mesquite chips are soaked in the treatment solution described above along with the application of heat and simmered for an appropriate time and thereafter allowed to dry. Once the mesquite chips are dried, they may be further ground to a fine consistency for mixing with the vegetable mixture now consisting of bran, corn silk and soybean flakes previously prepared.

An inert filler may be added to the vegetable and mesquite mixture to produce a heavier and more tobacco-like ash. The preferred components for this purpose are the carbonates of sodium, calcium and magnesium, either individually or in combination. The inert filler material is mixed into the vegetable mixture in a mixing device such as a rotary mixer imparting a tumbling action.

Finally, in order to more closely simulate the taste and flavor of a tobacco cigarette, a fine mist of a tobacco flavoring concentrate combined with a suitable humecant is sprayed as a fine mist on the mixture previously prepared. Glycerin may be used as a humectant and the volatile oils of menthol, mint or of other commercially available tobacco flavoring agents may be added. Other specialized flavor and aroma-imparting ingredients known to those in the art may also be employed in order to create a product which closely simulates a true tobacco product. Other such flavors include vanilla extract, walnut extract and oil of eucalyptus.

The resulting product is then stored in a closed container for a predetermined period of time and followed by a mild toasting treatment in an oven. The flavoring process may be repeated several times to develop a final product with the most desirable taste and aroma for the intended use.

The product is now ready for use as a tobacco substitute and for example may be formed into cigarettes using standard cigarette production equipment.

EXAMPLE

The following example illustrates the manner in which the present invention may be practiced. A satisfactory composition for use as a tobacco substitute containing little or no tar or nicotine and still retaining desirable smoking properties was prepared according to the example. The treatment solution was first prepared by mixing the following:

(1) One part sodium chloride, 10% aqueous solution by volume (2) One part by volume viscous solution of honey and water having the approximate consistence of a simple syrup.

(3)One part glycerol by volume.

(4) One part potassium nitrate, 5% aqueous solution by volume

Note the volumetric percentages are approximate and may vary substantially.

The unprocessed wheat bran is soaked in the treatment solution for an extended period for between ten to thirty days.

A combination by weight of the unprocessed and solution treated wheat bran (75% by weight) and cornsilk (25% by weight) are mixed and blended in a rotating drum.

Soybeans are initially treated by soaking the material in the treatment solution described above for an extended period of approximately seven to ten days. Thereafter, the soy soak is heated and allowed to simmer for approximately one hour and then decanted to allow the soy material to dry. Thereafter the soybean material is subjected to mild heat in an oven to achieve toasting. The toasted soybean material is then placed in a blender to reduce the consistency suitable for mixing with bran and cornsilk. The resulting soy flakes have the general appearance and size of corn flakes. The toasted soy flakes are then added to the bran and cornsilk mixture in approximate amounts of 40% by weight of the soy flakes and 60% by weight of the bran/cornsilk mixture.

Mesquite is prepared by placing the mesquite wood, such as branches and limbs, in a chopper to reduce the wood to the consistency of fine chips. The mesquite is then soaked in the treatment solution described above for an extended period, as for example ten to twenty days. Thereafter, the mesquite solution is heated and simmered for one to two hours and dried. The dried chips are ground to a fine consistency and mixed with soyflake, cornsilk and bran mixture in the approximate amounts of mesquite 40% by weight, soyflake, cornsilk and bran mixture 60% by weight.

An inert filler material is added to the mixture of bran, cornsilk, soyflake and mesquite to make a heavier and improved ash upon burning. The filler material is selected from one of the carbonates of sodium, calcium or magnesium, or a combination of these carbonates. The mixing of the filler is accomplished by tumbling action in a rotary drum. The filler additive should be approximately 7% by weight of the total soyflake, cornsilk, bran and mesquite mixture.

The resulting or final mixture has the following approximately percent by weight of the final composition;

Constituent—% By Weight Of Finished Product

Filler—7.0%
Mesquite—37.2%
Soy Flakes—22.4%
Bran—25.1%
Corn Silk—8.3%

It has been found that the above composition provides a pleasing tobacco substitute. However, personal tastes vary and the relative amount of each constituent may vary as much as 20%–25%.

Finally, to simulate the taste and flavor of tobacco cigarettes, the mixture previously prepared consisting of bran, corn silk, mesquite flakes and filler is sprayed with a fine mist of tobacco concentrate and a suitable humecant which serves to keep the mixture moist. The humecant typically is glycol or a similar well-known humecant and the flavoring agent any of the volatile flavor oils, such as menthol, mint or one of the many tobacco flavoring agents commercially available.

The product is then stored in a closed container and aged for a suitable period for several days. After aging, the mixture may be further treated by mild toasting in an oven. The flavoring process may also be repeated several times to develop the final product having the desired taste and aroma.

It has been found that the smoking material so produced has substantially the same appearance, texture, color and flavor as conventional tobacco cigarettes but with little or no nicotine and tar, thus rendering the material more acceptable to smoking use.

The completed product is now ready for forming cigarettes using standard cigarette production machinery or may be otherwise packaged for pipe or cigar use. Additional shredding according to conventional techniques may be utilized. The tobacco product may be formed into cigar filler and cigar wrapper material as is conventional.

Obviously numerous variations in the description of the invention set forth herein will be apparent to those skilled in the art. For example, it is obvious that the treatment solution may be varied. Also, additive materials other than those described above may be employed. Accordingly, such variations and modifications of the disclosed process and the product made by the process as are embraced by the spirit and scope of the appended claims and are contemplated being within the scope of the present invention.

I claim:

1. An improved smoking composition comprising the following ingredients:

(a) a mixture of vegetable fibers consisting of bran in an amount of approximately 20% to 30% by weight and corn silk in an amount of approximately 5% to 10% by weight which have been treated in a treatment solution prepared from approximately equal parts by volume of saline, glycerol, sweetener and a flavoring agent;

(b) soy flakes in an amount of approximately 15% to 35% by weight which have been treated in a treatment solution prepared from approximately equal parts by volume of saline, glycerol, sweetener and flavoring agents and thereafter dried and blended; and (c) mesquite chips present in an amount of approximately 30% to 45% by weight which have been treated in a treatment solution prepared from approximately equal parts by volume of saline, glycerol, sweetener and a flavoring agent and thereafter dried and ground.

2. The smoking composition of claim 1 further including a filler consisting of the carbonates selected from the group of sodium, calcium and magnesium.

3. The smoking composition of claim 1 wherein the resulting mixture of bran, cornsilk, soyflakes and mesquite is treated with a flavor concentrate and humectant.

4. The smoking composition of claim 1 wherein the bran is selected from the group consisting of wheat, oats, rye or barley.

5. The smoking composition of claim 1 wherein said treatment solution is prepared from one part by volume of sodium chloride 10% aqueous solution, one part by volume of honey and water, one part by volume of glycerol and one part by volume of potassium nitrate 5% aqueous solution.

6. A process for preparing a tobacco substitute product which comprises:

(a) soaking bran in a solution consisting of approximately equal parts by volume of NaCl 10% aqueous solution, viscous sweetener, glycerol, and potassium nitrate 5% aqueous solution;

(b) mixing the soaked wheat bran with corn silk in a percentage by weight of bran approximately 75% and corn silk approximately 25%, to form a vegetable fiber mixture;

(c) soaking soy beans in a solution consisting of approximately equal parts by volume of NaCl 10% aqueous solution, viscous sweetener, glycerol, and potassium nitrate 5% aqueous solution and thereafter decanting and blending to form soy flakes;

(d) mixing the soy flakes and vegetable fiber mixture in a percentage by weight of approximately 40% soy flakes and 60% vegetable fiber mixture;

(e) soaking chopped mesquite wood in a solution consisting of approximately equal parts by volume of NaCl 10% aqueous solution, viscous sweetener, glycerol, and potassium nitrate 5% aqueous solution and thereafter drying and grinding to form mesquite ground chips; and (f) mixing the vegetable fiber and soy flake mixture with the mesquite ground mixture in a percentage by weight of approximately 60% to 40%, respectively.

7. The process of claim 6 further including the steps adding an inert filler, flavor concentrate and humectant to the product.

8. The process of claim 6 wherein said product is stored in a closed container and thereafter mildly roasted to enhance flavor and aroma.

9. The process of claim 7 wherein the flavoring agent is a volatile oil.

10. The process of claim 7 wherein the filler is selected from the group consisting of the carbonates of sodium, calcium or magnesium.

11. The process of claim 7 wherein the resulting product contains by weight approximately 7% filler, 37% mesquite, 22% soybean, 25% bran and 8% cornsilk.

* * * * *